US009873255B2

(12) United States Patent
Sasaki et al.

(10) Patent No.: US 9,873,255 B2
(45) Date of Patent: Jan. 23, 2018

(54) LIQUID EJECTION HEAD AND METHOD OF MANUFACTURING THE SAME

(71) Applicant: CANON KABUSHIKI KAISHA, Tokyo (JP)

(72) Inventors: Koji Sasaki, Nagareyama (JP); Kenji Fujii, Yokohama (JP); Jun Yamamuro, Yokohama (JP); Kazuhiro Asai, Kawasaki (JP); Seiichiro Yaginuma, Kawasaki (JP); Keiji Matsumoto, Fukushima (JP); Kunihito Uohashi, Yokohama (JP); Masahisa Watanabe, Yokohama (JP); Tomohiko Nakano, Kawasaki (JP); Keiji Edamatsu, Kawasaki (JP); Haruka Nakada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/079,499

(22) Filed: Mar. 24, 2016

(65) Prior Publication Data

US 2016/0311222 A1 Oct. 27, 2016

(30) Foreign Application Priority Data

Apr. 27, 2015 (JP) ..... 2015-090401

(51) Int. Cl.
*B41J 2/16* (2006.01)

(52) U.S. Cl.
CPC ..... *B41J 2/162* (2013.01); *B41J 2/1603* (2013.01); *B41J 2/1631* (2013.01); *B41J 2/1632* (2013.01); *B41J 2/1639* (2013.01); *B41J 2/1645* (2013.01)

(58) Field of Classification Search
CPC .... B41J 2/14032; B41J 2/1404; B41J 2/1433; B41J 2002/14411; B41J 2002/14475; B41J 2/162; B41J 2/135; B41J 2/14; B41J 2/14201
See application file for complete search history.

(56) References Cited

U.S. PATENT DOCUMENTS

2005/0130075 A1 6/2005 Shaarawi et al.
2013/0286098 A1* 10/2013 Yabe ..... B41J 2/1433 347/47

FOREIGN PATENT DOCUMENTS

JP 4498363 B2 7/2010

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A liquid ejection head includes a substrate having an energy generating element arranged therein and an ejection port forming member laid as superposed above the substrate. At least one ejection port is formed so as to run through the ejection port forming member. The ejection port forming member has a concave portion including the ejection port formed therein on the surface thereof opposite to the surface thereof facing the substrate, and has a convex portion on the surface of the ejection port forming member facing the substrate so as to correspond to the concave portion.

2 Claims, 5 Drawing Sheets

LIQUID EJECTION HEAD AND METHOD OF MANUFACTURING THE SAME

BACKGROUND OF THE INVENTION

Field of the Invention

The present invention relates to a liquid ejection head and a method of manufacturing the same.

Description of the Related Art

Improved durability has been required in recent years to liquid ejection heads to be used for liquid ejection device, which include inkjet recording device and are designed to eject liquid such as ink onto a recording medium for recording, from the viewpoint of suppressing recording quality degradation. For example, Japanese Patent No. 4,498,363 discloses an arrangement of providing the region of an inkjet recording head where an ejection port is formed with a recessed portion (a concave portion). As pointed out above, an inkjet recording head is a type of liquid ejection head. With this arrangement, damages to the ejection port caused by wiping the ejection port forming surface can be minimized to consequently prolong the effective service life of the liquid ejection head.

More specifically, according to Japanese Patent No. 4,498,363, the photoresist layer 21, which constitutes the ejection port forming member of an inkjet recording head, is exposed to light once by way of a mask 22 and then developed to produce a concave portion 23 in the ejection port forming surface 21*a* as illustrated in FIGS. 6A and 6B of the accompanying drawings of the patent specification. Thereafter, as illustrated in FIGS. 6C and 6D, the photoresist layer 21 is exposed to light by way of another mask 24 for the second time with irradiation energy lower than the energy of the first irradiation and then developed to produce an ejection port 25, which is a through hole, in the inside of the concave portion 23, and the photoresist layer 21 is baked at a high temperature.

SUMMARY OF THE INVENTION

The present invention provides a liquid ejection head including: a substrate having an energy generating element arranged therein; and an ejection port forming member laid as superposed above the substrate, an ejection port being formed so as to run through the ejection port forming member; a region of the ejection port forming member including the ejection port having a concave portion formed in the surface thereof opposite to the surface thereof facing the substrate; a convex portion being formed in the surface of the ejection port forming member facing the substrate so as to correspond to the concave portion.

Further features of the present invention will become apparent from the following description of exemplary embodiments with reference to the attached drawings.

DESCRIPTION OF THE EMBODIMENTS

The manufacturing method described in Japanese Patent No. 4,498,363 requires two exposure steps to make the manufacturing steps complex, prolong the time for manufacture and consequently raise the manufacturing cost because firstly a concave portion 23 is formed on the ejection port forming surface 21*a* of the ejection port forming member (the photoresist layer 21) and subsequently an ejection port 25 is formed there.

Therefore, the object of the present invention is to provide a liquid ejection head having a concave portion on the ejection port forming surface thereof that can be manufactured in a simple manner and also a method of manufacturing such a liquid ejection head.

Now, currently preferable embodiments of the present invention will be described below.

Figure 1:
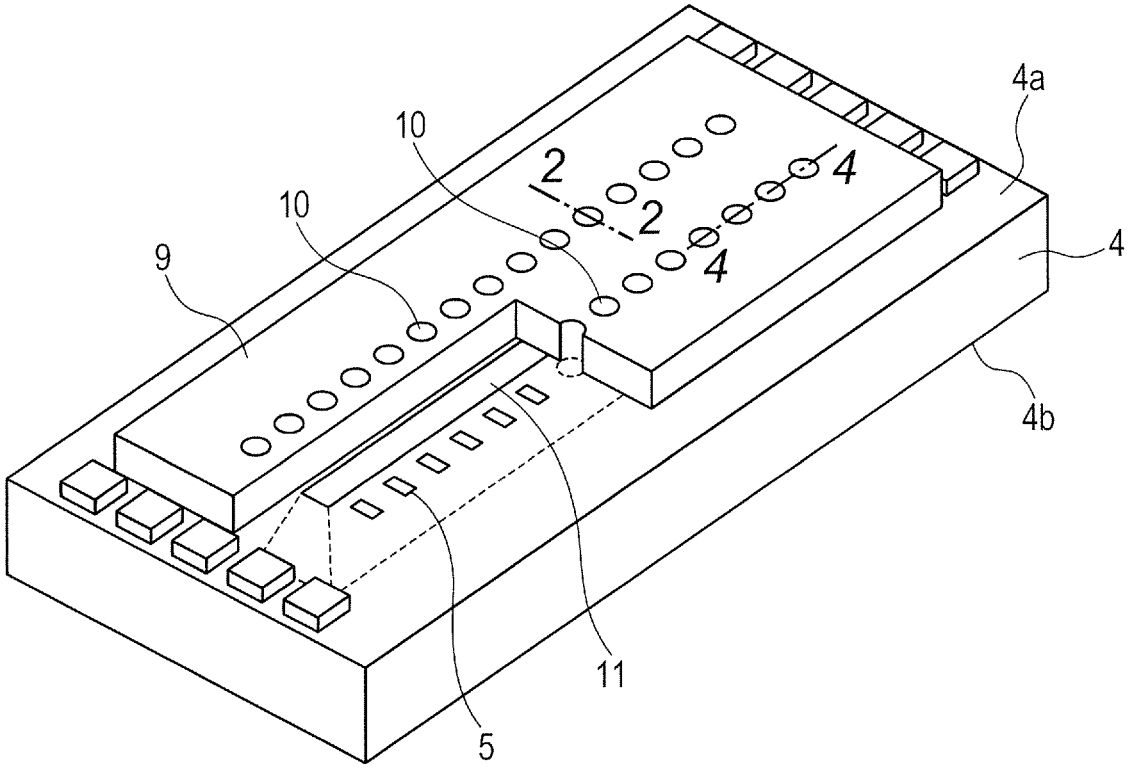
FIG. 1 is a schematic perspective view of an embodiment of a liquid ejection head according to the present invention.

FIG. 1 schematically illustrates the basic structure of a liquid ejection head that can be manufactured in the present invention. While the present invention will be described below in terms of inkjet recording heads as advantageous examples to which the present invention is applicable, the present invention is by no means limited to inkjet recording heads. In other words, the present invention is also applicable to liquid ejection heads that can be employed for preparation of biochips, electronic circuit printings, manufacturing color filters and so on.

The liquid ejection head illustrated in FIG. 1 includes a substrate 4 that is typically made of silicon, an ejection port forming member 9 and a flow path forming member (not illustrated in FIG. 1) arranged between the substrate 4 and the ejection port forming member 9 and designed to operate as lateral walls of the pressure chambers of the liquid ejection head. In the following description, the front surface of the substrate 4 (the upper surface in FIG. 1) will be referred to as the first surface 4*a* and the rear surface of the substrate 4 (the lower surface in FIG. 1) will be referred to as the second surface 4*b*. Energy generating elements 5 are formed at the side of the first surface 4*a* of the substrate 4. The energy generating elements 5 may typically be heat emitting resistors or piezoelectric elements. A feed path 11 that runs through the substrate 4 so as to link the first surface 4*a* to the second surface 4*b* is also formed. An ejection port forming member 9 is laid as superposed above the first surface 4*a* of the substrate 4 so as to cover the first surface 4*a*. Although not illustrated in FIG. 1, concave portions are formed on the front surface of the ejection port forming member 9 (the surface of the ejection port forming member opposite to the surface thereof facing the substrate 4) of the liquid ejection head while convex portions are formed on the rear surface (the surface of the ejection port forming member 9 facing the substrate 4) so as to correspond to the respective concave portions. Ejection ports 10 that run through the ejection port forming member 9 are arranged in the insides of the respective concave portions.

Figure 2A:
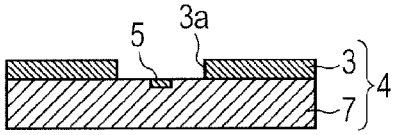
FIGS. 2A, 2B, 2C, 2D, 2E, 2F, 2G and 2H are schematic cross-sectional views of an embodiment of a liquid ejection head according to the present invention in sequential steps of manufacturing the liquid ejection head.

Now, a method of manufacturing a liquid ejection head according to the present invention will be described below. FIGS. 2A through 2H are schematic cross-sectional views of a part of an embodiment of liquid ejection head according to the present invention taken along a line that corresponds to line 2-2 in FIG. 1 in various intermediate stages on the way of manufacturing the liquid ejection head, although a single energy generating element is represented there. Firstly, as illustrated in FIG. 2A, a substrate 4 having energy generating elements 5 at the side of the first surface 4*a* is prepared. The substrate 4 includes a principal part 7 and a hollow pattern layer 3 formed on the principal part 7. As illustrated in FIG. 3, the hollow pattern layer 3 is formed to enclose the areas for forming energy generating elements 5 so as to expose the respective energy generating elements 5. Differently stated, the energy generating elements 5 are located in the insides of the respective hollows 3*a* of the hollow pattern layer 3. The thickness of the hollow pattern layer 3 needs to be selected as a function of the desired depth of the concave portions 15 and is preferably between 0.5 μm and 5 μm. While the hollow pattern layer 3 is formed by means of a negative type photosensitive resin in this embodiment, the hollow pattern layer 3 is not limited to the above-described material and may be an adhesion enhancing layer for enhancing the adhesion between the substrate 4 and the flow path forming member of the liquid ejection head.

Figure 2B:
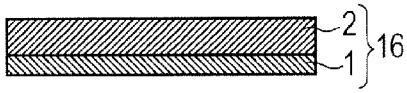
Figure 3:
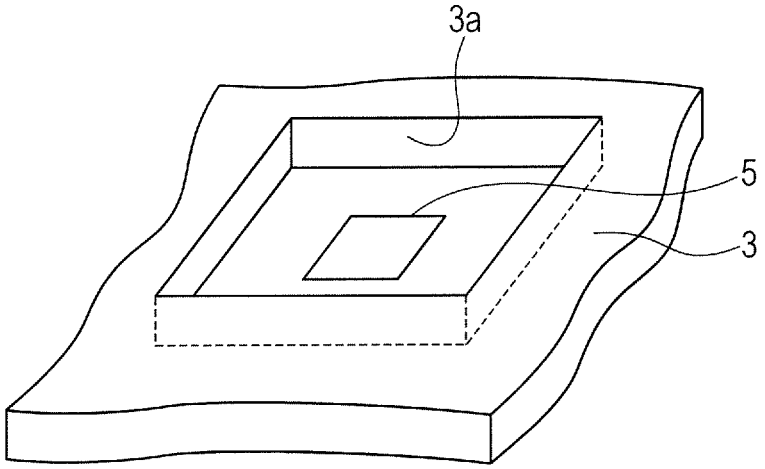
FIG. 3 is a schematic perspective partial view of the liquid ejection head of FIGS. 2A through 2H, representing the substrate and the hollow pattern layer thereof.

Then, as illustrated in FIG. 2B, a laminate 16 of a support 1 and a first dry film 2 supported by the support 1 is prepared. Material examples that can be used for the support 1 include resin film, glass and silicon. In view of that the support 1 is peeled off in a later manufacturing step, the support 1 is preferably made of resin film. Examples of resin film that can be used for the support 1 include PET (polyethylene terephthalate) film, polyimide film, polyamide film and polyaramide film. The surface of the support 1 may be subjected to a releasing treatment in order to make the support 1 to be easily peeled away from the first dry film 2.

The first dry film 2 constitutes the flow path forming member. It is made of filmy resin. The resin that is employed to form the first dry film 2 is preferably photosensitive that has a softening point not lower than 40° C. and not higher than 120° C. and is easily soluble to organic solvents. Examples of such resin include epoxy resin, acrylic resin and urethane resin. For the purpose of the present invention, examples of epoxy resin include bisphenol A epoxy resin, cresol novolac epoxy resin and alicyclic epoxy resin and examples of acrylic resin include polymethyl methacrylate, while examples of urethane resin include polyurethane. Solvents that can be used to dissolve any of the above-listed resins include PGMEA (propylene glycol methyl ether acetate), cyclohexanone, methyl ethyl ketone and xylene. The viscosity of the resin composition obtained by dissolving the resin into the solvent is preferably not lower than 5 cP and not higher than 150 cP. The obtained resin composition is applied onto the support 1 by spin coating or slit coating, heated to a temperature typically not lower than 50° C. and dried to produce the first dry film 2, which is a resin layer, on the support 1. When dried, the first dry film 2 on the support 1 preferably represents a thickness of not less than 3 μm and not more than 30 μm. More preferably, the first dry film 2 represents a thickness of not less than 4 μm and not more than 25 μm so that the first dry film 1 may represent a rigidity that allows it to be reliably held on the hollows 3*a* of the hollow pattern layer 3 after peeling off the support 1 as will be described in greater detail hereinafter.

Figure 2C:
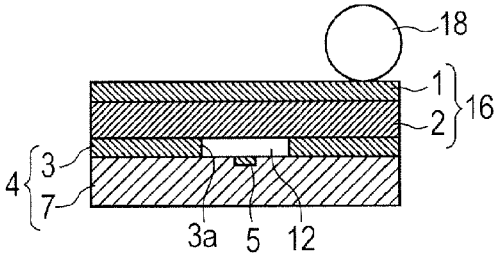

Then, as illustrated in FIG. 2C, the laminate 16 of the support 1 and the first dry film 2 is placed on the hollow pattern layer 3 on the substrate 4 so as to make the first dry film 2 to be located vis-à-vis the hollow pattern layer 3. Because the first dry film 2 needs to be rigidly adhered to the hollow pattern layer 3 except the hollows 3*a*, the first dry film 2 is preferably heated to a temperature not higher than the softening point thereof, more preferably to a temperature very close to the softening point thereof, and crimped to the hollow pattern layer 3. As the first dry film 2 is placed on the hollow pattern layer 3, the first dry film 2 covers the hollows 3*a* of the hollow pattern layer 3 to produce spaces (cavities) 12 in the respective hollows 3*a* of the hollow pattern layer 3 and the first dry film 2 is made to adhere and become crimped to the hollow pattern layer 3 in all the area thereof other than the hollows 3*a*. Additionally, as the temperature of the first dry film 2 is brought to a temperature level lower than its softening point thereof, the first dry film can be prevented from being excessively deformed and flowing into the hollow 3*a* of the hollow pattern layer 3. The softening point of the first dry film 2 can be determined typically by means of a thermomechanical analyzer (TMASS 6100: available from SII).

A roller method of employing a rotating roller 18 may be used as a technique of crimping the first dry film 2 to the hollow pattern layer 3. Alternatively, although not illustrated, a bulk surface press method of employing a press having a surface profile larger than the contact area of the first dry film 2 and the hollow pattern layer 3 may be used. Particularly, the use of a roller method is preferable because air bubbles can efficiently be driven away as the roller 18 is driven so as to keep on rotating on the laminate 16, constantly pressing the laminate 16 against the hollow pattern layer 3. Besides, in order to eliminate the cavities 12 produced between the first dry film 2 and the hollow pattern layer 3 in the heating step that comes later, the first dry film 2 needs to be crimped to the hollow pattern layer 3 in a reduced pressure environment, preferably in an environment that represents a vacuum degree of not higher than 100 Pa. The cavities 12 can be regulated by appropriately selecting the pressure and the duration that are selected for crimping the first dry film 2 to the hollow pattern layer 3. Thereafter, the support 1 is peeled away from the first dry film 2.

Figure 2D:
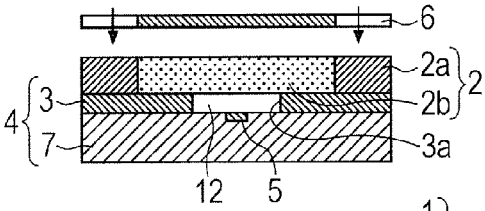

Then, as illustrated in FIG. 2D, a first mask 6 representing an aperture pattern that corresponds to the desired profile of the flow path is laid on the photosensitive first dry film 2. Then, light is irradiated onto the first dry film 2 by way of the first mask 6 to produce a latent image of the profile of the flow path on the first dry film 2 (the first irradiation step). In FIG. 2D, the exposed region 2*a* of the first dry film 2 is discriminated from the unexposed region 2*b* thereof by representing the unexposed region 2*b* as a dotted region. Thereafter, a heat treatment process is executed to improve the adhesion between the first dry film 2 and the substrate and the durability of the first dry film 2. In this embodiment, since the first dry film 2 is made of a negative type photosensitive resin, the flow path is produced when a part (the unexposed region 2*b*) of the first dry film 2 is removed in a later step.

Figure 2E:
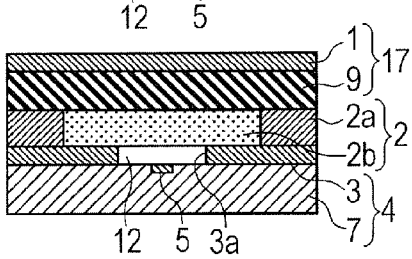

Then, as illustrated in FIG. 2E, another laminate 17 having a second dry film 9 supported on the support 1 is placed on the first dry film 2. After transferring the second dry film 9 onto the first dry film 2 by way of a crimping process, the support 1 is peeled away from the second dry film 9. The second dry film 9 constitutes the ejection port forming member and may be made of a material similar to the material of the first dry film 2. Note, however, that the second dry film 9 desirably has a photosensitive wavelength range or a gelation sensitivity that is different from the photosensitive wavelength range or the gelation sensitivity of the first dry film 2. In this embodiment, the sensitivity of the second dry film 9 is higher than the sensitivity of the first dry film 2.

Note, however, that the present invention is not limited to the use of a laminate 17 having a second dry film 9 supported on the support 1 and a second dry film 9 may alternatively be formed by applying a liquid resin composition onto the first dry film 2 and drying the resin composition. If such is the case, the resin composition may be arranged on the first dry film 2 by applying the resin composition by means of spin coating or slit coating or by transferring the resin composition onto the first dry film 2 by means of a lamination technique or a press technique. The first dry film 2 and the second dry film 9 may be made to represent different photosensitive wavelength ranges by differentiating the sensitivity of the first dry film 2 and that of the second dry film 9 relative to light that is irradiated to them at the time of exposure.

Figure 2F:
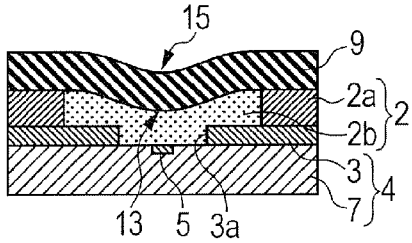

Thereafter, a heat treatment process is executed to soften the first dry film 2 and the second dry film 9 by heat. At this time, each of the cavities 12 that is produced by the corresponding hollow 3*a* is under negative pressure as it is surrounded by the first dry film 2 and the hollow pattern layer 3 and hence the first dry film 2 is mobilized and drawn into the cavity 12 as illustrated in FIG. 2F. The second dry film 9 is locked with the movement of the first dry film 2 and deformed so as to produce a convex portion 13 on the rear surface thereof and a concave portion 15 on the front surface thereof. Both the first dry film 2 and the second dry film 9 are preferably heated to above the respective softening points. It is known that the volume of the concave portion 15 on the front surface of the second dry film 9 that is produced in this way agrees with the volume of the hollow 3*a* of the hollow pattern layer 3. Besides, the concave portion 15 on the front surface of the second dry film 9 may change its profile depending on the temperature and the duration of the heating step. Therefore, the concave portion 15 on the surface of the second dry film 9 can be controlled by controlling the volume of the hollow 3*a* and the temperature and the duration of the heating step.

Figure 2G:
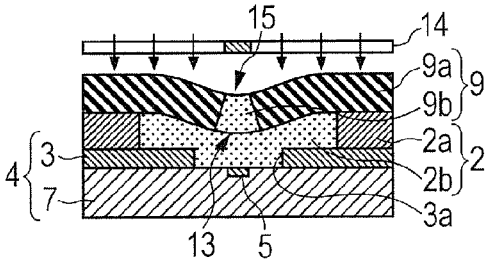

Then, as illustrated in FIG. 2G, the second dry film 9 is subjected to a patterning process. For example, a second mask 14 may be arranged on the second dry film 9 and light may be irradiated onto them to produce an exposed region 9*a* and an unexposed region 9*b* (the second irradiation step). The irradiation dose (the irradiated energy) in the second irradiation step is smaller than the irradiation dose in the first irradiation step. Additionally, a PEB (post exposure bake) process is executed in order to improve the adhesion between the second dry film 9 and the substrate 4 and the durability of the second dry film 9.

Figure 2H:
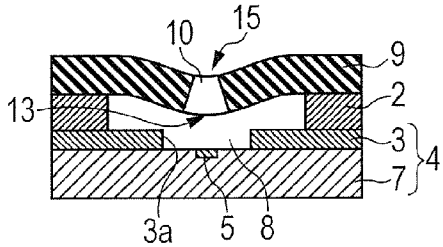
Figure 4:
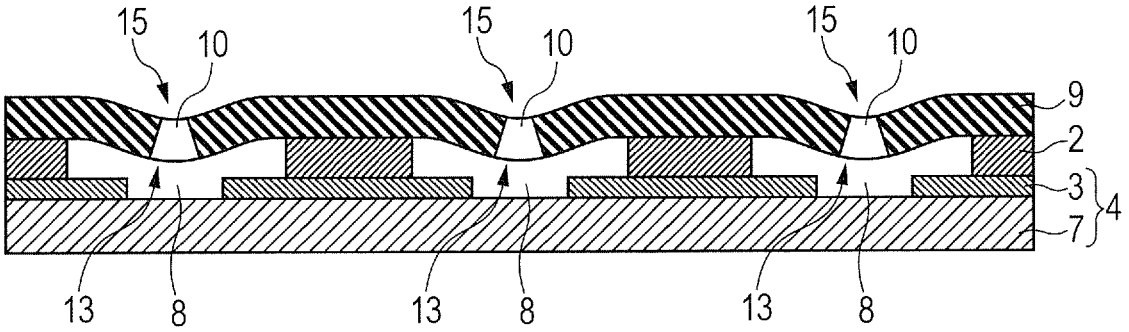
FIG. 4 is a schematic cross-sectional view of the liquid ejection head of FIGS. 2A through 2H, illustrating the manufacturing step of FIG. 2H from a view angle different from that of FIG. 2H.

Then, as illustrated in FIG. 2H, the substrate 4 and the first and second dry films 2 and 9 are immersed in a photographic developer to collectively remove the unexposed regions 2*b* and 9*b*. This state is also illustrated in FIG. 4 which is a cross-sectional view taken along line 4-4 in FIG. 1. Examples of developer solution that can be used for this purpose include PGMEA, tetrahydrofuran, cyclohexanone, methyl ethyl ketone and xylene. As a result of this development process, a pressure chamber 8 and an ejection port 10 that communicates with the pressure chamber 8 are produced. Subsequently, a feed path 11 is formed in the substrate 4.

In actual manufacturing of a liquid ejection head, the above-described manufacturing steps are executed by using a substrate 4 and laminates 16 and 17 having a large area. Subsequently the substrate 4 and the laminates 16 and 17 are cut into chips typically by means of a dicing saw (not illustrated) and the produced chips are separated from each other. Then, an electrical bonding process is executed for the purpose of driving the energy generating elements 5 and chip tank members for ink feeding are connected to the respective chips. A complete liquid ejection head, which may be an inkjet recording head as illustrated in FIG. 1, is produced in the above-described manner. With the manufacturing method of this embodiment, a liquid ejection head having concave portions 15 in the regions for forming ejection ports 10 can be manufactured with ease.

With the above-described arrangement, each ejection port 10 is arranged in the inside of a concave portion 15 and therefore the ejection ports 10 and their surrounding areas are prevented from being damaged by operations of wiping the ejection port forming surface of the liquid ejection head to consequently prolong the effective service life of the liquid ejection head. Besides, the concave portions 15 can be formed with ease by locally deforming the second dry film 9, which is the ejection port forming member, without executing two separate exposure steps so that the time and the cost for manufacturing the liquid ejection head can be held low. While the ejection port forming member (the second dry film 9) is deformed toward the inside of each of the hollows of the hollow pattern layer 3 along with the flow path forming member 2 (the first dry film 2), it is not cut away except the ejection ports 10. Then, consequently, concave portions 15 are arranged at the surface (front surface) of the ejection port forming member 9 opposite to the surface thereof located vis-à-vis the substrate 4 and convex portions 13 that correspond to the respective concave portions 15 are arranged at the surface (rear surface) thereof located vis-à-vis the substrate 4. As a result of this arrangement, the thickness of the ejection port forming member 9 at the concave portions 15 and that of the ejection port forming member 9 at all the remaining part are substantially equal to each other. Therefore, when this embodiment having the above-described arrangement is compared with a conventional liquid ejection head having concave portions as illustrated in FIGS. 6A through 6D and if the cross-sectional area of the outlet parts of the ejection ports 10 (the hollow parts exposed to the outside) represents the same value for both this embodiment and the conventional liquid ejection head, the cross-sectional area of the inlet parts of the ejection ports 10 (hollow parts at the substrate 4 side) of this embodiment is larger than that of the conventional liquid ejection head representing a reduced thickness at the concave portions 15 (see FIG. 6D). Thus, the liquid ejection head 10 can be made to represent a small resistance to the liquid that is being ejected and hence the liquid ejection head 10 can be provided with required ejection characteristics by using only small energy generating elements 5. The net result will be that the liquid ejection head represents an excellent energy efficiency. Additionally, the size and the depth of the concave portions 15 can be controlled by controlling the volume of the hollows 3*a* of the hollow pattern layer 3 and the heating temperature and the heating time for softening the first and second dry films 2 and 9. Thus, this manufacturing method can produce concave portions 15 having a desired volume and a desired profile with ease.

With the arrangement of the present invention, each ejection port is arranged in the inside of a concave portion and therefore the ejection ports and their surrounding areas are prevented from being damaged by operations of wiping the ejection port forming surface of the liquid ejection head so that the effective service life of the liquid ejection can consequently be prolonged. Besides, the concave portions 15 can be formed with ease by locally deforming the second dry film 9, which is the ejection port forming member, without executing two separate exposure steps so that the time and the cost for manufacturing the liquid ejection head can be held low. Furthermore, since concave portions are arranged at the surface of the ejection port forming member opposite to the surface thereof located vis-à-vis the substrate and convex portions that correspond to the respective concave portions are arranged at the surface thereof located vis-à-vis the substrate, the ejection port forming member can be made to represent a substantially constant thickness. Therefore, the cross-sectional area of the inlet parts of the ejection ports (the hollow portions at the side of the ejection port forming member located vis-à-vis the substrate) is not reduced significantly and any significant increase of resistance at the time of liquid ejection can be prevented from taking place.

Example 1

The above-described manufacturing method of the present invention will be explained more specifically by way of examples. In Example 1, polyether amide was used for hollow pattern layer 3 of the substrate 4 so as to make it operate as an adhesion enhancing layer arranged between the main portion 7 of the substrate 4 and the first dry film 2 and subjected to a patterning process by means of a photolithography technique using mask resist (the first mask 6) as illustrated in FIG. 2A. The film thickness of the hollow pattern layer 3 was 2 μm. The flat part of each of the hollows 3*a*, which was a part for forming an energy generating element 5, represented a square contour profile of 40 μm×40 μm.

The support 1 of the laminate 16 illustrated in FIG. 2B was made of PET film. The first dry film 2 was prepared by applying a solution obtained by dissolving photosensitive resin (epoxy resin TMMF: trade name, available from Tokyo Ohka Kogyo Co., Ltd.) in solvent (PGMEA) onto the support 1 by slit coating and then drying the solution. The first dry film prepared in this way was made of negative type photosensitive resin and had a film thickness of 14 μm. The softening point of the first dry film 2 was measured by using a sample obtained by cutting the first dry film 2 to a small piece of 8 mm×8 mm and a thermomechanical analyzer (TMASS6100: trade name, available from SII). The softening point was found to be equal to 48° C.

Then, a laminate 16 was arranged on the substrate 4 as illustrated in FIG. 2C and crimped onto the substrate 4 by means of a roll type laminator (VTM-200: trade name, available from Takatori Corporation) in conditions including vacuum degree of 100 Pa, temperature of 60° C. and pressure of 0.4 MPa. Thereafter, the support 1 was peeled away from the first dry film 2 at room temperature. Since the cavity 12 was formed in a reduced pressure environment while the first dry film 2 was covering the hollows 3*a* of the hollow pattern layer 3, the internal pressure thereof was 100 Pa, the cavities 12 were held in place by the rigidity of the first dry film 2 when it was exposed to the atmosphere.

Then, as illustrated in FIG. 2D, the first dry film 2 having a photosensitive property was exposed to light to form a pattern thereon such that the unexposed region 2*b* that was to be removed in a latter step was to represent the desired profile of a flow path. The first dry film 2 was exposed to light having a wavelength of 365 nm at an exposure of 6,000 J/m$^2$ by means of an exposure machine (FPA-3000i5+: trade name, available from Canon) and by way of a first mask 6 having a pattern that corresponds to the profile of the flow path. Subsequently, a PEB process was executed at 45° C. for a duration of 5 minutes. Since the temperature of the PEB process was not higher than the softening point, the cavities 12 did not represent any profile change.

Then, as illustrated in FIG. 2E, a laminate 17 was placed on the first dry film 2. The second dry film 9 of the laminate 17 was prepared by applying the solution obtained by dissolving photosensitive resin (epoxy resin TMMF: trade name, available from Tokyo Ohka Kogyo Co., Ltd.) in solvent (PGMEA) onto the PET film that was the support 1 by slit coating and drying the solution. The second dry film 9 prepared in this way was made of negative type photosensitive resin and had a film thickness of 11 μm. The softening point of the second dry film 9 was measured by means of a thermomechanical analyzer (TMASS6100: trade name, available from SII) to find that the softening point was equal to 40° C. Then, the laminate 17 was crimped onto the first dry film 2 by means of a roll type laminator (VTM-200: trade name, available from Takatori Corporation) in conditions including vacuum degree of 100 Pa, temperature of 50° C. and pressure of 0.2 MPa. Thereafter, the support 1 was peeled away from the second dry film 9 at room temperature. The cavities 12 did not represent any profile change.

Thereafter, a heat treatment process was executed at 90° C. for 5 seconds. As a result, both the first dry film 2 and the second dry film 9 were softened and got into the cavities 12 that had been formed from the respective hollows 3*a* in the hollow pattern layer 3 as illustrated in FIG. 2F. Consequently, concave portions 15 that were 40 μm-long, 40 μm-wide and about 2 μm-deep were formed on the front surface of the second dry film 9, whereas convex portions 13 that correspond to the respective concave portions 15 were formed on the rear surface of the second dry film 9.

Then, as illustrated in FIG. 2G, the second dry film 9 having a photosensitive property was exposed to light to form a pattern thereon over all the region thereof (exposed region 9*a*) except the unexposed regions 9*b* that were to be removed in a latter step and become an ejection port 10. The exposure machine described earlier was also used for this process of exposing the second dry film 9 to light having a wavelength of 365 nm at a rate of 1,100 J/m$^2$ in order to form a pattern thereon by way of a second mask 14 having a pattern that corresponds to the desired profile of the ejection port 10. Thereafter, a PEB process of heating the second dry film 9 at 90° C. for five minutes was executed.

Subsequently, as illustrated in FIG. 2H, the unexposed regions 2*b* and 9*b* of the first dry film 2 and the second dry film 9 were removed by means of a developer solution (PGMEA) and thereafter a heat treatment process of heating them at 200° C. for an hour was executed. After preparing an ejection port forming member 9 having concave portions 15 in desired regions by way of the above-described steps, a feed path 11 was formed in the substrate 4. Then, the substrate 4 and the first and second dry films 2 and 9 were cut to produce separate chips by means of a dicing saw or the like (not illustrated) and an electric bonding process and a process of connecting a chip tank member (not illustrated) were executed. Inkjet recording operations were executed by using the liquid ejection head manufactured in this way and having concave portions 15 where ejection ports 10 had been formed to find that the ejection ports 10 and their surrounding areas were hardly damaged and represented an improved durability.

Example 2

Figure 5A:
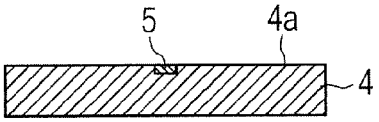
FIGS. 5A, 5B, 5C, 5D, 5E, 5F, 5G and 5H are schematic cross-sectional views of another embodiment of a liquid ejection head according to the present invention in sequential steps of manufacturing the liquid ejection head.
Figure 5B:
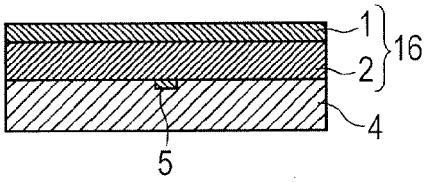
Figure 5C:
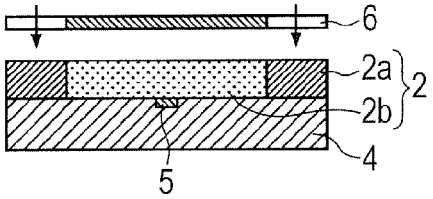
Figure 5D:
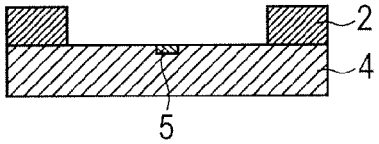
Figure 5E:
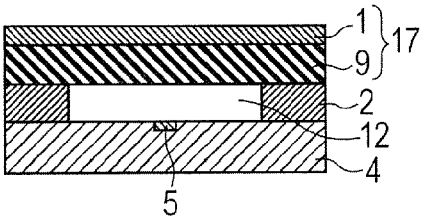
Figure 5F:
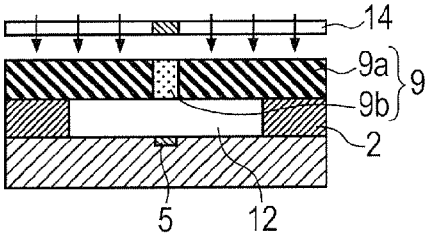
Figure 5G:
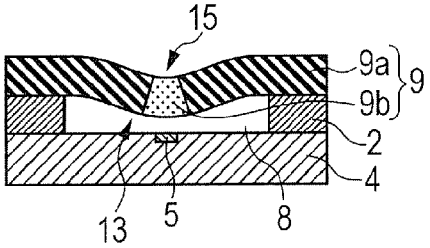
Figure 5H:
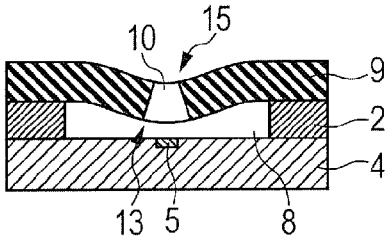
Figure 6A:
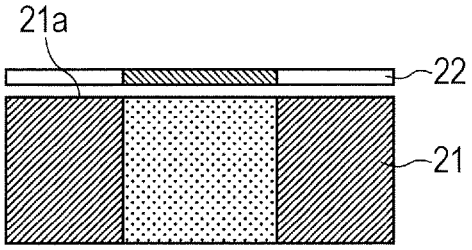
FIGS. 6A, 6B, 6C and 6D are schematic cross-sectional views of a liquid ejection head described in Japanese Patent No. 4,498,363, representing a principal part thereof and illustrating the method of manufacturing the same.
Figure 6B:
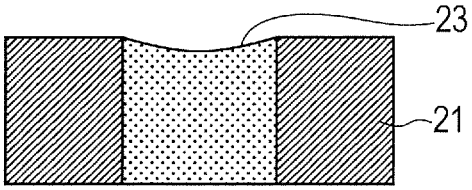
Figure 6C:
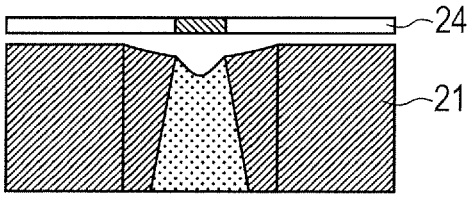
Figure 6D:
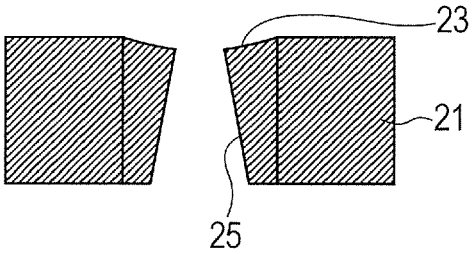

In Example 2 of this invention, a substrate 4 having energy generating elements 5 on its first surface 4*a* was prepared as illustrated in FIG. 5A. Then, a laminate 16 similar to the laminate of Example 1 was arranged on the substrate 4 (FIG. 5B) without forming any hollow pattern layer 3 and the support 1 was peeled off before the first dry film 2 was exposed to light to form a pattern thereon (FIG. 5C). Then, a PEB process of heating at 50° C. for 5 minutes was executed and subsequently a developing process was executed by means of PGMEA solution (FIG. 5D). Then, a laminate 17 was arranged on the substrate 4 where the first dry film 2 had been formed as in Example 1 (FIG. 5E) and the support 1 was peeled off before the second dry film 9 was exposed to light to form a pattern (FIG. 5F). Subsequently, a PEB process of heating at 60° C. for 5 minutes was executed. As a result of the PEB process, the second dry film 9 was softened and the softened second dry film 9 got into the cavities 12 of the first dry film 2 as illustrated in FIG. 5G. Then, consequently, concave portions 15 that were 40 μm-long, 40 μm-wide and about 2 μm-deep were formed on the front surface of the second dry film 9 whereas convex portions 13 that corresponded to the respective concave portions 15 were formed on the rear surface of the second dry film 9 and the sizes of the cavities 12 were reduced to produce respective pressure chambers 8 there. Then, as illustrated in FIG. 5H, the unexposed regions 9*b* of the second dry film 9 were removed by means of a developer solution (PGMEA) to produce ejection ports 10 and subsequently a heat treatment process of heating at 200° C. for an hour was executed. Then, the substrate 4 and the first and second dry films 2 and 9 were cut to produce separate chips by means of a dicing saw (not illustrated) and an electric bonding process and a process of connecting a chip tank member (not illustrated) were executed. In this way, the concave portions 15 can be controlled in terms of profile and size by controlling the temperature and the duration of the PEB process relative to the second dry film. Thus, this example shows that the time and the cost for manufacturing a liquid ejection head can be reduced because it did not require the use of a hollow pattern layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-090401, filed Apr. 27, 2015, which is hereby incorporated by reference herein in its entirety.

What is claimed is:

1. A liquid ejection head comprising:

a substrate having an energy generating element arranged therein;

an ejection port forming member laid so as to be superposed above the substrate, an ejection port being formed so as to run through the ejection port forming member, a port region of the ejection port forming member including the ejection port having a concave portion formed in the surface thereof opposite to the surface thereof facing the substrate, a convex portion being formed in the surface of the ejection port forming member facing the substrate so as to correspond to the concave portion;

a flow path forming member arranged between the ejection port forming member and the substrate so as to constitute the lateral wall of a pressure chamber; and a hollow pattern layer arranged between the flow path forming member and the substrate and having a hollow therein, wherein the ejection port and a feed path arranged in the substrate communicate with each other by way of the pressure chamber, and the ejection port forming member is partly deformed toward the hollow of the hollow pattern layer.

2. The liquid ejection head according to claim 1, wherein the thickness of the port region of the ejection port forming member is equal to the thickness of all the remaining regions of the ejection port forming member.

* * * * *